United States Patent [19]

Huang

[11] Patent Number: 4,776,716

[45] Date of Patent: Oct. 11, 1988

[54] CLEANING DEVICE WITH PIVOTABLE HEAD

[75] Inventor: Chii M. Huang, Kaohsiung, Taiwan

[73] Assignee: Sunshine Industries, Inc., Cleveland, Ohio

[21] Appl. No.: 25,012

[22] Filed: Mar. 12, 1987

[30] Foreign Application Priority Data

Mar. 15, 1986 [TW] Taiwan ..... 75201992

[51] Int. Cl.[4] ..... A47L 1/08

[52] U.S. Cl. ..... 401/139; 15/172; 15/185; 401/27

[58] Field of Search ..... 401/139, 27; 15/172, 15/185, 220

[56] References Cited

U.S. PATENT DOCUMENTS

| | | | |
|---|---|---|---|
| 424,716 | 4/1890 | Lichtenstein | 15/172 |
| 1,033,022 | 7/1912 | Kress | 15/185 |
| 1,838,158 | 12/1931 | Schwartz | 15/220 R |
| 2,216,026 | 9/1940 | Smith | 15/185 X |
| 2,741,789 | 4/1956 | Ray | 401/139 |

FOREIGN PATENT DOCUMENTS

| | | | |
|---|---|---|---|
| 1151795 | 2/1958 | France . | |
| 899033 | 7/1949 | Fed. Rep. of Germany | 15/172 |
| 2316276 | 10/1974 | Fed. Rep. of Germany . | |
| 1330348 | 9/1973 | United Kingdom . | |

OTHER PUBLICATIONS

Brochure, 1986, U.S. General Company, promoting a Spray-Type Window Washer.

*Primary Examiner*—Steven A. Bratlie

*Attorney, Agent, or Firm*—Watts, Hoffmann, Fisher & Heinke Co.

[57] ABSTRACT

This foldable multipurpose cleaning device comprises a fluid-receiving receptacle member detachably connected to a cleaning head assembly. The receptacle member includes a plunger and dispensing means for the fluid. The cleaning head assembly includes an elongated scraper or squeegee and an elongated brush or sponge borne on a carriage member, an intermediate coupling member projecting from the carriage member and comprising a female housing member with a locking notch in its base, a slotted body member topped with a male head portion that has near its base a lug that is engagable with the notch on the female housing member in a releasable gripping relationship when the carriage member is in a generally horizontal position for operation, the female housing member being pivotally attached to the male head portion by means of oppositely-disposed pivot pin elements projecting from the male head portion into corresponding pivot slots in the female housing member for slip joint action therebetween.

3 Claims, 4 Drawing Sheets

CLEANING DEVICE WITH PIVOTABLE HEAD

TECHNICAL FIELD

The present invention relates to cleaning devices, and more particularly relates to a multi-purpose cleaning device in the form of a manual squeegee-type cleaning device that incorporates a fluid containing hollow body, an actuating assembly for dispensing fluid from the body, and a pivotal squeegee head member which includes a cam-type locking mechanism for releasably holding the squeegee head member in the operating position thereof.

BACKGROUND OF THE INVENTION

The present invention relates to a squeegee-type cleaning device. Heretofore, such prior cleaning devices have generally included a squeegee device having a fixed squeegee head adapted for use especially in the cleaning of windows or the like. In such cases, it was required that a separate receptacle be utilized for containing the liquid cleaning fluid that was generally dispensed from the receptacle via a spray nozzle. Sprayed accordingly, it was required to maintain two separate components of the cleaning system, namely, the squeegee and the spray-nozzle dispenser to carry out the cleaning operation. In addition, the fixed head of the squeegee member would not allow the device to be readily stored after useage particularly in limited space areas.

DISCLOSURE OF THE INVENTION

In the present invention, there is provided a new and novel multi-purpose squeegee-type cleaning device that overcomes the difficulties with use of prior cleaning devices of a similar nature. In the present invention, the cleaning device incorporates a hollow fluid containing receptacle having a detachable spray nozzle assembly for manually dispensing fluid from the receptacle. The device incorporates a pivotal squeegee head member having an absorbent, flexible cleaning element for distributing the cleaning fluid sprayed by the spray nozzle assembly with the squeegee head member being disposed for pivotal movement in at least one direction about a horizontal axis that extends perpendicular to the longitudinal central axis of the hollow receptacle body. The pivotal connection is provided by a cam mechanism that cooperates with cam follower members for allowing pivotal movement of the head member from a horizontal locking position to a generally vertically oriented storage position, and incorporating an axially slidable locking mechanism for releasably locking the squeegee head member in the horizontal operating position. The squeegee head member further includes a wiper edge member for removing applied fluid to the working surface after application to the working surface by the spray nozzle assembly and the squeegee head applicator member.

In the invention, the squeegee device in another form incorporates a scraper blade element for removing snow or ice from a windshield, for example.

In essence, the present invention provides a one-handed cleaning device that incorporates a sponge, squeegee and spray bottle all in one. Moreover, there is no need to carry three separate pieces, especially in high places. The device is constructed and arranged so that the head folds away for easy storage. In operation, one simply pulls up on the sponge head so that a lock button is cleared to swing the head. The head moves one way only. Reverse procedure for opening is simply to push the head down so that the lock button snaps into place.

The cleaning device of the invention can be used on windows, mirrors, tubs, tile, walls, fiberglass boats, cars and the like.

RELATED APPLICATIONS

The present application relates to and claims priority from applicant's Taiwanese application filed Mar. 15, 1986 under Application Ser. No. 75201992.

BEST MODE FOR CARRYING OUT THE INVENTION

Figure 1:
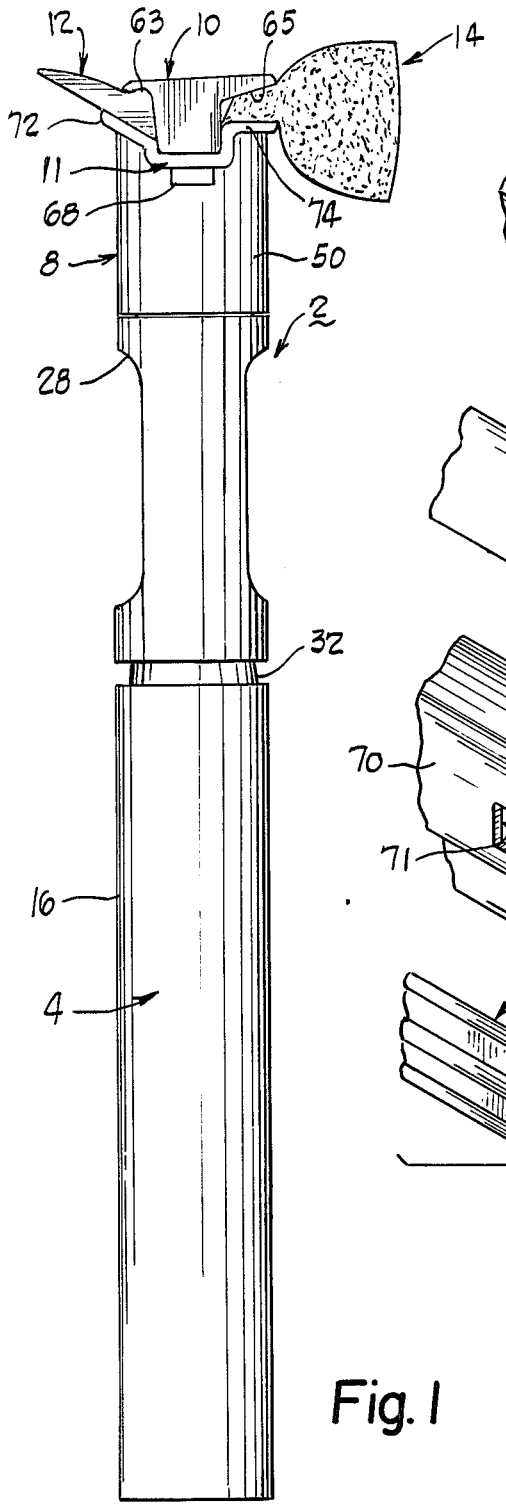
FIG. 1 is a side elevation view illustrating the cleaning device of the present invention.
Figure 6:
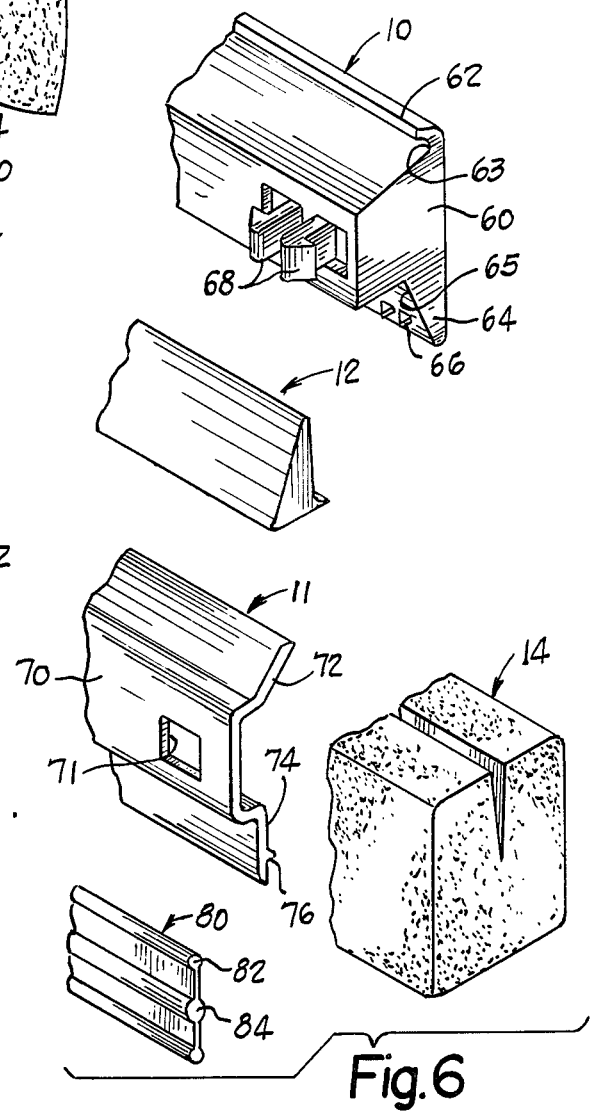
FIG. 6 is a fragmentary, assembly view illustrating the component parts for mounting the cleaning sponge in accordance with the present invention.

Referring again to the drawings and in particular to FIG. 1 thereof, there is illustrated the cleaning device of the present invention, designated generally at 2 including a fluid containing receptacle 4 and a detachable head assembly 6 for mounting a cleaning assembly via an intermediate coupling member 8.

Figure 4:
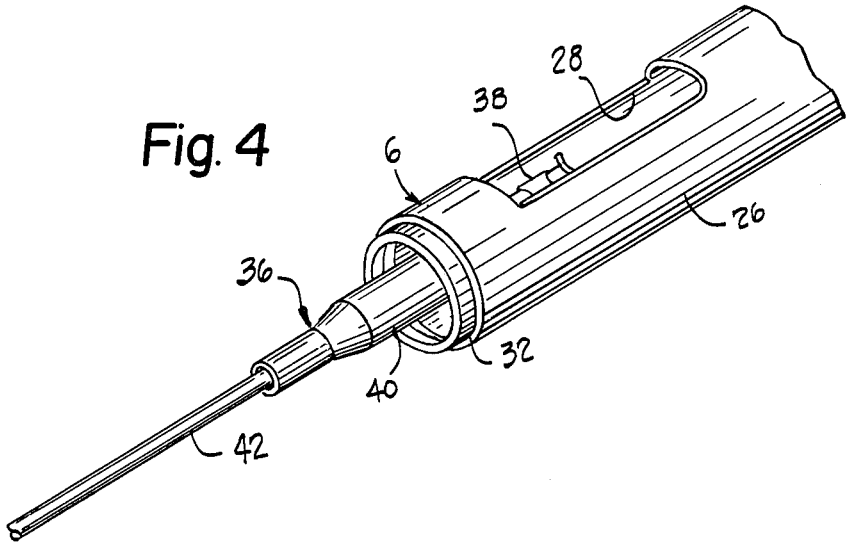
FIG. 4 is a fragmentary, generally perspective view illustrating the fluid actuator mechanism of the present invention.
Figure 5:
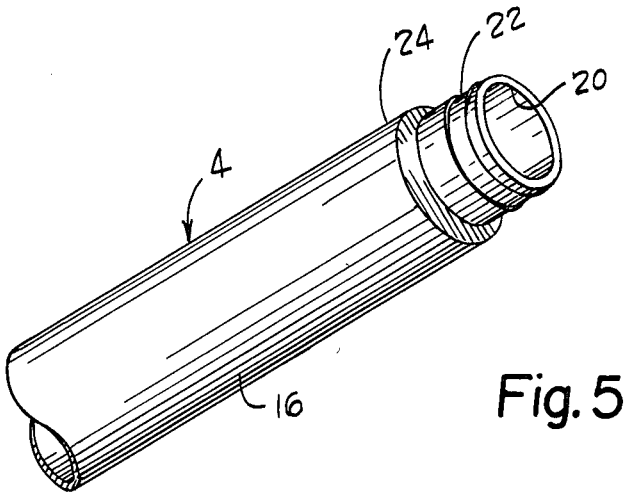
FIG. 5 is a fragmentary, generally perspective view illustrating one end of the fluid receptacle of the present invention.
Figure 7:
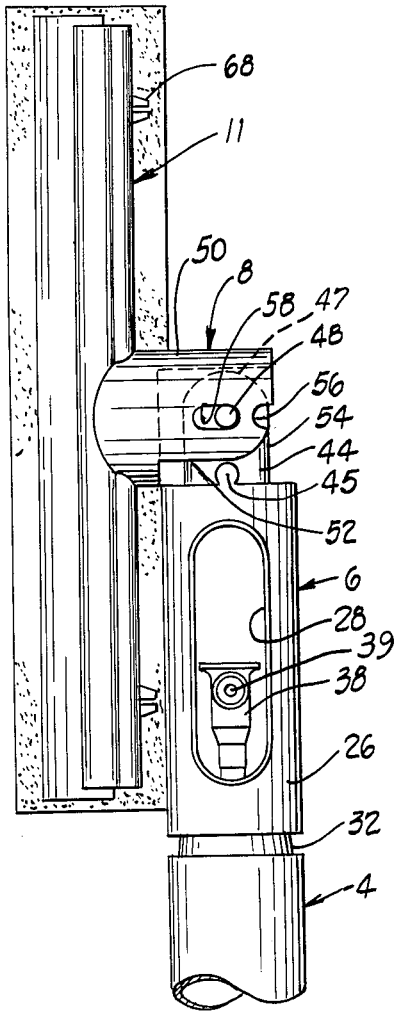
FIG. 7 is a fragmentary, elevation view illustrating a pivoted and stored position of the cleaning head.

As illustrated, the fluid receptacle 4 includes an elongated cylindrical body member 16 defined by a bottom 18 and an endless sidewall 24 (FIG. 5) and having a reduced diameter end portion 20 which is threaded, as 22, for threading engagement with the body at 26 of the head assembly 6. Accordingly, the threads 22 are threaded into a cap member 32 that is fixedly secured within the body member 26. As best illustrated in FIGS. 4 and 7, the cap member 32 mounts a conventional hand-operated plunger member 38 that is received within a hollow housing 40. The plunger member 38 has an integral hollow tube 42 (FIG. 4) for receipt within the receptacle 16 for delivering fluid out through a spray nozzle 39 upon actuation of the plunger 38. This spray nozzle assembly is designated generally at 36 in FIG. 4. Accordingly, the fluid receptacle may contain any suitable cleaning fluid and may be easily detachable connected to the body member 26 by the threaded connection between the component parts.

Figure 2:
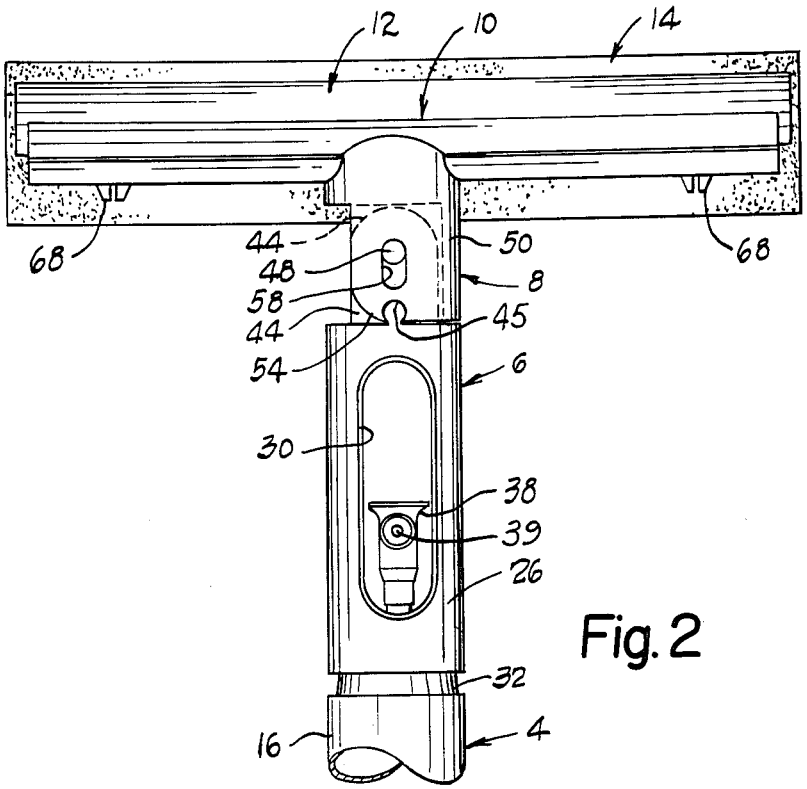
FIG. 2 is a fragmentary, front elevation view illustrating the cleaning device of the present invention.
Figure 3:
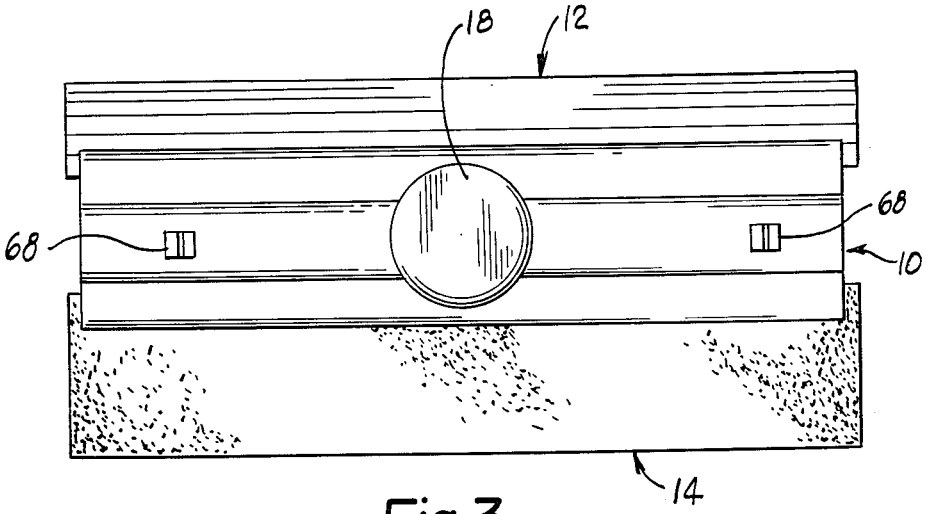
FIG. 3 is a top plan view looking down on the cleaning device illustrated in FIG. 2.

As best illustrated in FIGS. 2 and 7, the head assembly 6 includes an elongated, cylindrical body member 26 having a pair of oppositely disposed elongated slots, as at 28 and 30, formed on opposite sides thereof to provide access to the fluid plunger 38. The slots 28 and 30 have an axial length and width sufficient to accommodate access to the operator's finger for actuating the plunger 38.

Figure 8:
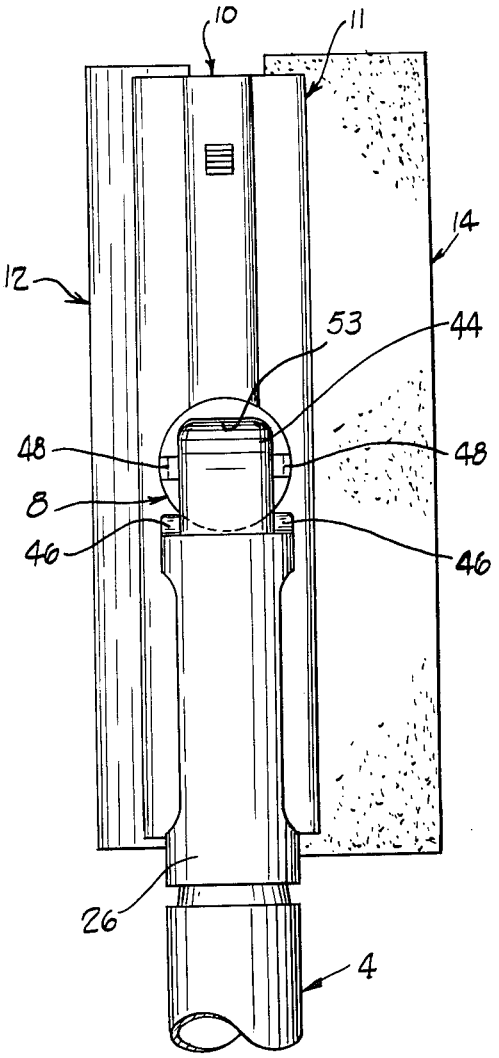
FIG. 8 is a fragmentary, front elevation view looking from the right hand side of FIG. 7.

An integral, hollow male head portion 44 extends upwardly and in centered relation relative to the body member 26. The head portion 44 is preferably of a polygonal (e.g. square) configuration in transverse cross-section and has a curved or rounded top surface, as at 47. The head portion 44 includes a pair of integral outwardly extending pin elements 46 adapted to slide-fit within corresponding generally semi-circular openings 56 provided in a female housing member 50. The female housing member 50 is of a hollow cylindrical construction having one side cut-out to provide a window-like opening 52 of a transverse width sufficient to receive corresponding transverse dimension of the male head portion 44 therein. As best seen in FIG. 8, the head portion 44 fits snug within the interior bore defined by the housing member 50. The head portion 44 is further provided with a pair of integral, outstanding second pin elements, as at 48, that engage within a pair of oppositely disposed axial slots 58 provided in the body member 50. The outer wall of the housing member 50 defining the window-like opening 52 includes curved cam-like surfaces 54 that act to ride upon the corresponding confronting surface of the pin elements 46 as the cleaning head is pivoted from a horizontal position (FIG. 2) into a vertical stored position, as illustrated in FIG. 7.

Accordingly, in operation the squeegee 12 is illustrated in the normal working or horizontal position (FIG. 2) and then may be pivoted in a counterclockwise direction into the stored position illustrated in FIG. 7. In the working position, the pin elements 46 are engaged within the cut-out openings 56 with the second set of pin elements 48 being disposed at the top of the axial slots 58. To pivot the squeegee, carriage member 11 is pulled axially upwardly in a vertical direction until the pin elements 48 bottom-out in the slots 58 so as to clear the pin elements 46 from within the openings 56 such that the squeegee can be pivoted in a counterclockwise direction with the curved surface 54 riding on the pin elements 46 in a cam-like action until the squeegee is in the vertically stored position illustrated in FIG. 7. To reverse the operation, the squeegee is simply pivoted in a clockwise direction about the pivot pin elements 48 until the housing member 50 is in a vertical position whereupon vertical forces applied to the cleaning assembly act to drive the cut-out openings 56 downwardly into surrounding relation around the pin elements 46 and with the pin elements 48 again bottoming-out at the upper end of the slots 58. In this position, the head is securely locked in position for normal cleaning operations.

In the invention, the cleaning assembly includes an elongated base or carriage member 11 of a channel-like construction having a base portion 70 that defines a generally U-shaped construction with a integral generally planar flange portion 74 and an outwardly and upwardly inclined flanged portion 72. The flange portion 74 has formed therein an integral longitudinally extending rib 76 to maximize gripping action with an elongated, elastomeric (rubber) squeegee member 12. An elongated female clamping member is constructed so as to fit within the base or carriage member 11 and has a solid body portion 60 with an integral upwardly inturned flange 62 defining a groove 63 for receiving a correspondingly shaped end edge of the squeegee 12. The opposite side of the body member 60 includes an integral inclined flange portion 64 having an outwardly and inwardly inclined surface 65 (FIG. 1) that coacts with its flange portion 74 for retaining the transverse dimension of a rubber or plastic foam sponge member 14 therein. Here again, the surface 65 may be provided with integral retention elements, as at 66, for maximizing the frictional securement with the sponge member 14.

As shown, the clamp member 10 has a pair of downwardly extending resilient tabs, as at 68, at opposed ends thereof adapted to be received within corresponding apertures, as at 71, provided in the base or carriage member 11 so as to provide a snap-fit connection for clamping the squeegee 12 and sponge members 14 against the confronting surfaces provided by the base or carriage member 11.

Figure 9:
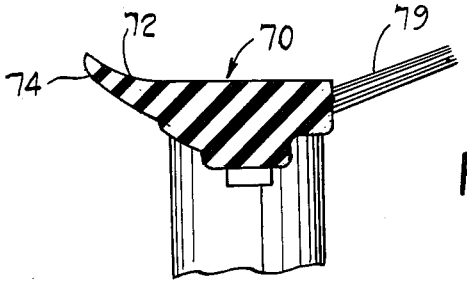
FIG. 9 is a fragmentary, elevation view illustrating a modification of the head wherein a scraper blade and brush may be utilized in place of the sponge and squeegee illustrated in FIG. 1.

In FIG. 9 there is illustrated a modification of the invention wherein the squeegee and sponge members may be replaced by a solid scraper (plastic) member 70 in conjunction with brush or bristle elements 79 for use in ice and/or snow removal applications, as desired. In such case the receptacle 4 may be provided with a suitable de-icer fluid or the like.

Other advantages and objects of the present invention are contemplated within the appended claims.

I claim:

1. A multi-purpose cleaning device of the type for cleaning automobiles, boats, windows and the like comprising an elongated hollow fluid-receiving receptacle member detachably connected to a cleaning head assembly, the receptacle member including a plunger and dispensing means for dispensing a fluid contained in the receptacle member, the cleaning head assembly including:

an elongated scraper or squeegee and an elongated brush or sponge borne by a carriage support member that has a coupling member projecting therefrom, said coupling member comprising a body member slotted for finger operation of the plunger and topped with a male head portion, and a female housing member having a locking notch at its base;

the male head portion having an enlarged lug that is engagable with and complementary to the locking notch on the female housing member in a releasable gripping relationship when the carriage support member is in a generally horizontal position for operation;

the female housing member being pivotally attached to the male head portion by means of oppositely-disposed pivot pin elements projecting from the male head portion into corresponding elongated pivot slots in the female housing member for slip joint action therebetween whereby vertical movement of the female housing member is limited but allows for unlocking of the lug from the notch and pivoting movement of the carriage support member from a generally horizontal position into a generally vertical position.

2. The head assembly of claim 1 wherein a clamping member with resilient tabs secures a squeegee and a sponge to the carriage member by snap-fit connection thereinto.

3. The head assembly of claim 1 wherein a unitary scraper and brush attaches to the carriage member.

* * * * *